US008813524B2

(12) United States Patent
Thompson

(10) Patent No.: US 8,813,524 B2
(45) Date of Patent: Aug. 26, 2014

(54) ADJUSTABLE STITCH HOLDER

(71) Applicant: Renee S Thompson, Chewelah, WA (US)

(72) Inventor: Renee S Thompson, Chewelah, WA (US)

( * ) Notice: Subject to any disclaimer, the term of this patent is extended or adjusted under 35 U.S.C. 154(b) by 0 days.

(21) Appl. No.: 14/089,745

(22) Filed: Nov. 25, 2013

(65) Prior Publication Data

US 2014/0144189 A1 May 29, 2014

Related U.S. Application Data

(60) Provisional application No. 61/730,515, filed on Nov. 28, 2012.

(51) Int. Cl.
*D04B 3/00* (2006.01)

(52) U.S. Cl.
CPC ..... *D04B 3/00* (2013.01)
USPC ..... 66/1 A

(58) Field of Classification Search
CPC ..... D04B 3/00; D04B 3/04; D04B 3/06; D04B 3/02; D04B 39/00; F16G 11/03; F16G 11/04; F16G 11/00
USPC ..... 66/1 R, 1 A, 4, 117, 118; 24/122.6, 130, 24/136 R, 136 L, 115 G
See application file for complete search history.

(56) References Cited

U.S. PATENT DOCUMENTS

| | | | | |
|---|---|---|---|---|
| 2,029,005 A | | 1/1936 | Webber | |
| 2,183,791 A | | 12/1939 | Dunn | |
| 2,242,880 A | | 5/1941 | Dunn | |
| 2,248,341 A | | 7/1941 | Crumb | |
| 2,274,572 A | | 2/1942 | Yates | |
| 2,335,482 A | | 11/1943 | Carlson | |
| 2,718,131 A | | 9/1955 | Black | |
| 2,930,213 A | | 3/1960 | Sorlie | |
| 3,280,595 A | | 10/1966 | Linstead | |
| 3,384,220 A | | 5/1968 | Linstead | |
| 3,438,223 A | | 4/1969 | Linstead | |
| 3,603,115 A | | 9/1971 | Elzey | |
| 4,007,610 A | | 2/1977 | Linstead | |
| 4,328,605 A | * | 5/1982 | Hutchison et al. | 24/115 G |
| D281,118 S | | 10/1985 | Gakiya | |
| 4,553,410 A | | 11/1985 | Okada | |
| 4,622,723 A | * | 11/1986 | Krauss | 24/115 G |
| 4,675,948 A | * | 6/1987 | Bengtsson | 24/115 G |
| 4,680,835 A | * | 7/1987 | Horng | 24/712.5 |

(Continued)

FOREIGN PATENT DOCUMENTS

| | | |
|---|---|---|
| GB | 191201626 | 12/1915 |
| GB | 485743 | 5/1938 |
| GB | 2100295 | 12/1982 |

*Primary Examiner* — Danny Worrell

(57) ABSTRACT

The adjustable stitch holder is a versatile and easy method for securely holding live stitches when knitting. The stitch holder allows for using smaller materials, a locking fastener and string, that are portable and take little storage room. Adjusting the locking fastener to a specific measurement allows an item to be tried on, to be measured properly, or to determine if the shape is correct. Because the string has little to no memory, the ends, regardless of length, will hang not pulling or distorting the knit material. In addition, the flexible string allows an item to be laid flat for measuring making the measurement more accurate. Further, stitches or knitted items have little chance of being damaged by the stitch holder and the stitch holder will conform to the knit item instead of being forced into a shape.

8 Claims, 4 Drawing Sheets

(56) References Cited

U.S. PATENT DOCUMENTS

| | | | | | |
|---|---|---|---|---|---|
| 4,680,947 | A | | 7/1987 | Phipps | |
| 5,323,514 | A | * | 6/1994 | Masuda et al. | 24/115 G |
| 5,365,641 | A | * | 11/1994 | Watanabe et al. | 24/115 G |
| 5,537,844 | A | | 7/1996 | MacLean | |
| 5,621,952 | A | * | 4/1997 | Frano | 24/115 G |
| 5,671,505 | A | * | 9/1997 | Anscher | 24/115 G |
| 5,737,808 | A | * | 4/1998 | Ikeda | 24/115 G |
| 6,018,851 | A | * | 2/2000 | Anscher | 24/115 G |
| 6,026,548 | A | * | 2/2000 | Jackson | 24/712 |
| 6,038,746 | A | * | 3/2000 | Anscher et al. | 24/115 G |
| 6,185,798 | B1 | * | 2/2001 | Ton | 24/712.1 |
| 6,334,240 | B1 | * | 1/2002 | Li | 24/115 G |
| D465,408 | S | * | 11/2002 | Man et al. | D8/395 |
| 6,581,256 | B2 | * | 6/2003 | Liu | 24/712.2 |
| 6,612,003 | B1 | * | 9/2003 | Liu | 24/712.5 |
| 6,681,460 | B2 | * | 1/2004 | Liu | 24/712.5 |
| 6,735,829 | B2 | * | 5/2004 | Hsu | 24/712.1 |
| D551,067 | S | * | 9/2007 | Kawamura | D8/383 |
| D560,477 | S | * | 1/2008 | Yoshie et al. | D8/383 |
| D560,478 | S | * | 1/2008 | Yoshie et al. | D8/383 |
| D560,479 | S | * | 1/2008 | Yoshie et al. | D8/383 |
| D586,648 | S | * | 2/2009 | Yoshie | D8/385 |
| D615,391 | S | * | 5/2010 | Kawaguchi | D8/383 |
| 7,954,342 | B2 | | 6/2011 | Devagnanam | |
| 8,181,489 | B2 | | 5/2012 | Selter | |
| 2008/0115334 | A1 | * | 5/2008 | Chen et al. | 24/115 G |

* cited by examiner

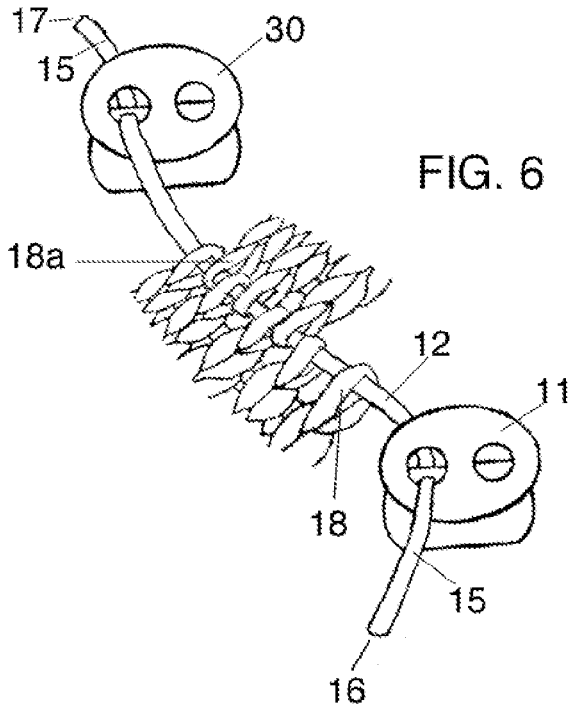
FIG. 6
FIG. 7
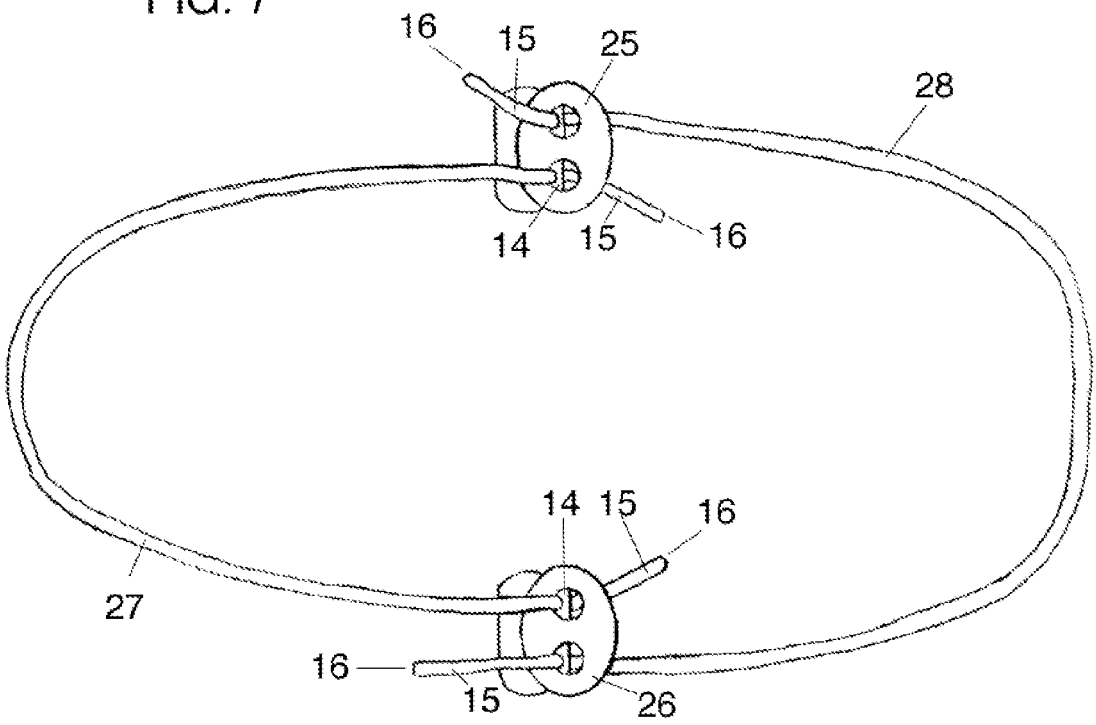

ADJUSTABLE STITCH HOLDER

CROSS-REFERENCE TO RELATED APPLICATIONS

This utility application claims the priority dated benefit of U.S. provisional application 61/730,515 filed on Nov. 28, 2012.

STATEMENT REGARDING FEDERALLY SPONSORED RESEARCH OR DEVELOPMENT

No Applicable.

REFERENCE TO SEQUENCE LISTING, A TABLE, OR A COMPUTER PROGRAM LISTING COMPACT DISK APPENDIX

Not Applicable.

BACKGROUND

Placing unfinished knitting or live knit stitches onto a device that will securely hold the live stitches without raveling typically requires a stitch holder to hold these stitches safely. Raveling stitches causes unnecessary time loss such as using extra time fixing the area or having to restart the entire project. There are many reasons for someone to set aside live stitches such as when finishing a different section of a garment, finishing a provisional seam when the person is unsure which edging they may wish to use, trying on a garment for fit, temporarily holding unfinished edges together, or needing to start a different project with knitting needles already being used.

A person cannot try on a garment for a precise fit using current stitch holders given the limited sizes when using a cable from an interchangeable needle set because the lengths are predetermined and cannot be adjusted. Furthermore, the current stitch holders distort the knitted item where it folds over on itself, bunches up unnaturally on itself, forces the item to be held straight or flat, or crowds the live stitches. Furthermore still, the current stitch holders unnecessarily change the shape of the knitted item because the knitted material is forced to conform to the material in or the shape of the stitch holder.

SUMMARY

The described embodiment is a locking fastener configured to accept and clamp a string where the string is a collector of a knitted product. The knitted product, for example, is a live or active knit stitches that are to be knitted at a later time.

An assembly for the locking fastener includes an outer element with a groove (e.g., "U"-shaped groove), an inner element that fits into the groove of the outer element, and a spring mechanism that couples the inner element to the groove. Furthermore, the outer element has a peripheral traverse slot penetrating through walls of the groove while the inner element has a slit, which is a through hole in the periphery of the inner element.

When the inner element moves towards the groove, the movement compresses the spring mechanism while it aligns the slit to the peripheral traverse slot. This aligning or overlapping between the slit and the peripheral traverse slot provides a passageway for the string to be fitted into the locking fastener. For example, the passageway forms a channel that is defined by alignment of the peripheral traverse slot and the slit. The slit forms as a middle of the channel. In this example, the channel is capable of fitting an end of the string and allows the string to pass through a hole that is created by the passageway.

A subsequent releasing of the spring mechanism from compression will then allow the inner element to move away from the groove. For example, the spring mechanism pushes the inner element towards an open front-section of the "U"-shaped groove. In this example, the inner element will pull the string through the slit and presses the string against an inside diameter of the peripheral traverse slot on the walls of the outer element. Thus, the inner element clamps the string against the outer element and thereby preventing it from slipping from the locking fastener.

BRIEF DESCRIPTION OF THE DRAWINGS

FIG. 6 exhibits an adaptation of the adjustable stitch holder for flat knitted pieces.

FIG. 7 demonstrates another adaptation of the adjustable stitch holder for knitted items with larger circumferences.

DETAILED DESCRIPTION

Figure 1:
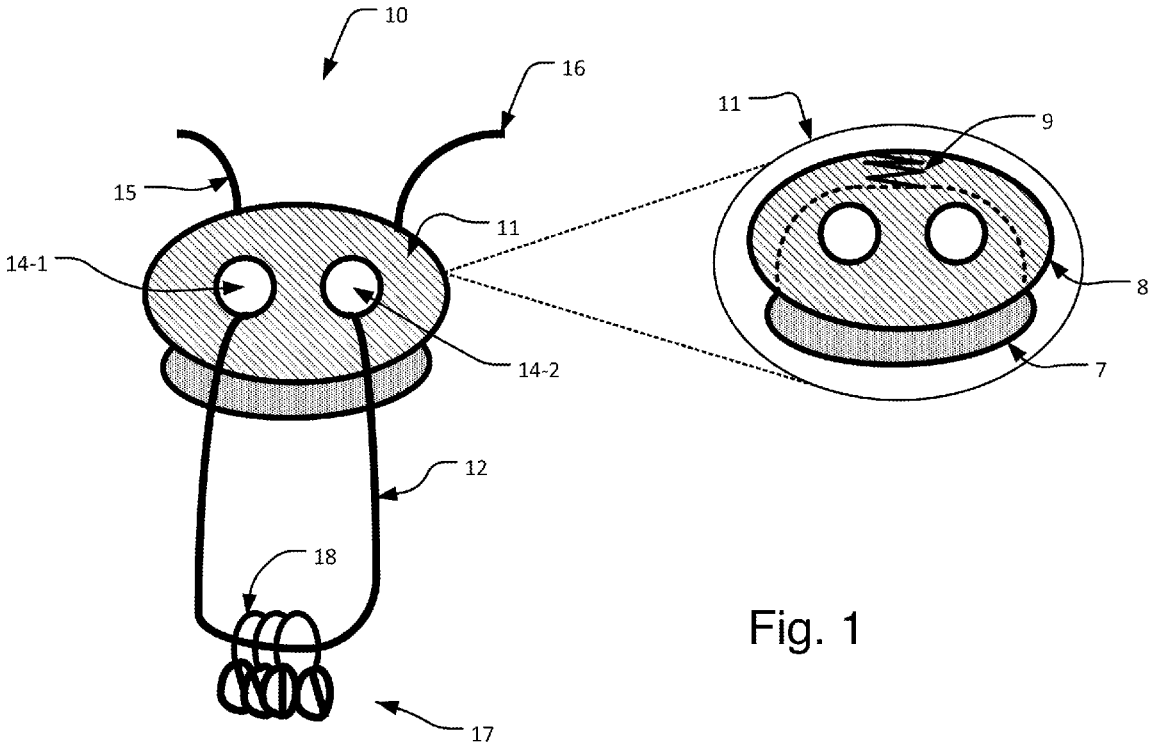
FIG. 1 is an isometric view of an adjustable stitch holder assembly.

FIG. 1 shows an adjustable stitch holder assembly 10 that includes a locking fastener 11, a string 12, a hole 14, a desired length 15, and a string end 16. Furthermore, the locking fastener 11 has an inner element 7, an outer element 8, and a spring mechanism 9. As shown, the stitch holder assembly 10 may hold active or live stitches 18. The active or live stitches 18 may be of a loop-shaped or line-shaped knitted product 17.

As an example of present implementations herein, the locking fastener 11 can have one or more holes 14 to secure the string 12. For example, the hole 14 is a hollow space or opening that traverses from one side of the locking fastener 11 to its opposite side. In this example, the hole 14 is a through hole with a circumference that is equal to or larger than the circumference of the string 12. In another example, the hole 14 has a smaller diameter than the diameter of the string 12; however, this requires squeezing of the string 12 in order to facilitate its entry through the hole 14.

As shown, a first hole 14-1 accepts the string end 16 and the string 12 freely extends through the first hole 14-1 until the desired length 15 is obtained at one side of the locking fastener 11. At this stage, the first hole 14-1 clamps the string 12 and prevents the string 12 from slipping away from the first hole 14-1 of the locking fastener 11.

A second hole 14-2 may then accept the string end 16 and create an adjustable loop-shaped string for holding the knitted product. For example, the second hole 14-2 accepts the string 12 and the string 12 freely extends through the second hole 14-2 until a desired size of the loop-shaped string is obtained. Upon obtaining the desired size of the loop-shaped string, the second hole 14-2 clamps the string 12 and prevents the string end 16 from slipping away from second hole 14-2 of the locking fastener 11.

With continuing reference to FIG. 1, the outer element 8 has a groove such as, for example, a "U"-shaped groove that may include an open front-section at top portion, and a closed rear-section at a bottom portion. Connecting the open front-section and the closed rear-section is a wall of the groove. For example, the wall may be cylindrical in shape for a cylindrical-shaped locking fastener 11 with cylindrical U-shaped groove or it may include two parallel sides of a rectangular U-shaped groove of a rectangular-shaped locking fastener 11.

The outer element 8 has a peripheral traverse slot that penetrates the walls of the groove. For example, in the U-shaped groove, the peripheral traverse slot is a space or a through hole that traverses one side of the wall and crosses to the other wall. In this example, the peripheral traverse slot crosses or passes through the space of the groove.

On the other hand, the inner element 7 has a slit that is also a through hole that traverses the body of the inner element 7. The slit may be of the same size and shape as that of the peripheral traverse slot of the outer element 8.

As an example of present implementations herein, the inner element 7 is partially disposed into the groove of the outer element 8. This position allows up and down movement of the inner element 7 to the groove of the outer element 8. Furthermore, the spring mechanism 9 that couples the partially disposed inner element 7 to the bottom portion of the groove allows the slit to align with the peripheral traverse slot.

For example, pushing the inner element 7 towards the direction of the groove compresses the spring mechanism 9. This movement provides overlapping of the peripheral traverse slot with the slit. The overlapping creates and increases a passageway in the hole 14. The passageway, for example, is a channel that is defined by alignment of the peripheral traverse slot and the slit. This alignment—in which the slit forms as a middle of the channel—may accept the string 12 to pass through the locking fastener 11.

A perfectly aligned peripheral traverse slot and slit may provide a maximum circumference or maximum diameter for the hole 14. In contrast, releasing the spring mechanism 9 from its compressed state to a resting position will move the slit into tangential position with the peripheral traverse slot. This tangential position, if there is no string 12 in the hole 14, provides no passageway or a zero diameter of the hole 14. Furthermore, the inner element 7 through its slit may clamp the string 12 against the outer circle element 8 when the slit is moving towards the tangential position.

The spring mechanism 9, at the resting position, pushes the inner element 7 away from the groove. The outer element 8 may include a stopper mechanism (not shown) that limits a maximum reach of the inner element 7 when moving up and down into the groove. For example, the stopper mechanism limits a maximum downward movement of the inner element 7 to a certain diameter of the hole 14. In this example, the stopper mechanism may allow a maximum diameter or a half-opened maximum passageway of the hole 14.

In another example, the stopper mechanism may limit the resting position of the spring mechanism 9 to a point where the inner element 7 is about to slip from the groove of the outer element 8. In this example, the resting position limits the spring mechanism 9 from extending beyond the tangential position as described above.

Figure 2:
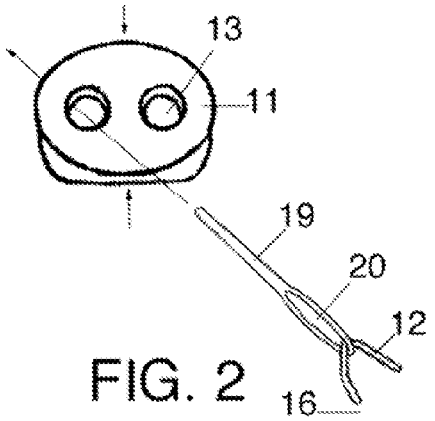
FIG. 2 is a front view of a locking fastener in open position.
Figure 3:
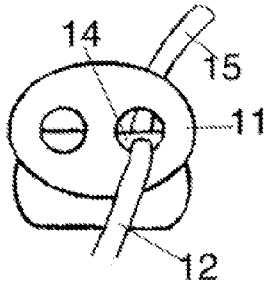
FIG. 3 shows, from the front, the locking fastener in the resting or closed position.

FIG. 2 shows an open hole 13 in the locking fastener 11. For example, the inner element 7 moves towards the groove of the outer element 8. This movement towards the groove causes the peripheral traverse slot and the slit to overlap one another. In this example, the overlapping creates the open hole 13. Releasing the spring mechanism 9 from its resting position by un-squeezing the inner element 7 may clamp the string 12 against the outer element 8. Thus, the locking fastener 11 firmly secures the string 12 from slipping from the hole 14 as shown in FIG. 3.

As shown, the locking fastener 11 can be of various types (e.g., cord lock, stopper, fastener, bean lock, or toggle used to adjust jacket drawstrings or secure laundry bags) while the string 12 may be made of a flexible cord such as a leather, polyester, thick thread, elastic, rope, twine, cording, yarn, cotton, rattail, rayon, etc. Furthermore, the locking fastener 11 may be of various shapes (e.g. barrel, bean, round, ball, rectangle, etc.) that is spring-loaded or manually activated.

As an example of present implementations herein, the locking fastener 11 and particularly, the outer element 8, has a surface perimeter that is greater than the surface of the knitted product to avoid inadvertent slipping of the stitches 18 from the string 12. The smallest common knitting needle size is "0" or 2 mm, so the string 12 weight recommended for common knitting would be less than 2 mm to accommodate a smaller knit stitch 18. However, the string weight is limited by the hole 14 size of the locking fastener 11 and the size of the knitting needle needed for the project. Selecting a string 12 color should consider the best contrast to the color of the knit item (e.g. white is seen better against black yarn and black is seen better against white yarn).

Figure 4:
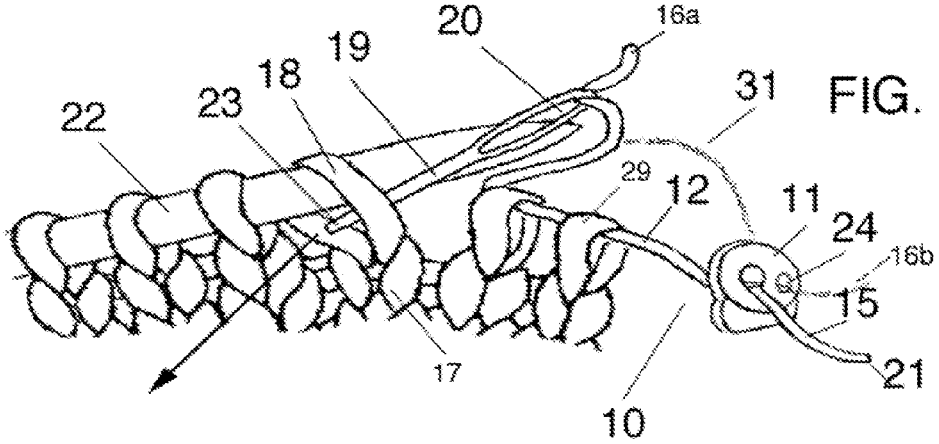
FIG. 4 is a diagram of how to place stitches onto the adjustable stitch holder.

FIG. 4 shows the elements for adding stitches 18 to the stitch holder. To start adding the stitches 18 to the stitch holder 10, the hole 14 accepts one end 21 of the string 12 and the hole 14 clamps the end 21 to stop the stitches 29 from slipping off. The string 12 may pass through the hole 14 without an aid of another device or it can be inserted by pulling the string 12 through a device 19 (e.g. tapestry or sewing needle with a hole) that holds the end 21 through an opening 20 while being pushed through the hole 13. Once the end 21 is secured in the locking fastener 11, the unsecured end **16*a* needs to be threaded through a device 19 with an opening 20**.

Once the string 12 is threaded, the device 19 slips through the live stitch 18 transferring the stitch 18 from the knitting needle 22 to the string 12 that holds the stitch 29. This process is repeated until the desired stitches 18 are transferred to the string 12. Once all the stitches 18 are place on the string 12, becoming stitch 29, the locking fastener 11 is opened, the unsecured end **16*a* threaded through the device 19 is pushed through the unused open hole 24, the locking fastener 11 is released, and the device 19 is removed from the string 12 end 16*b*. This process secures the stitches 29 to be knited later. The design allows for multiple knit pieces to be secured to one stitch holder 10 requiring fewer knitting notions to transport or store with the convenience of all pieces of a project or multiple projects held securely together. Since items can be removed or added to both ends, this provides better control of how the items are ordered on the stitch holder 10**.

Figure 5:
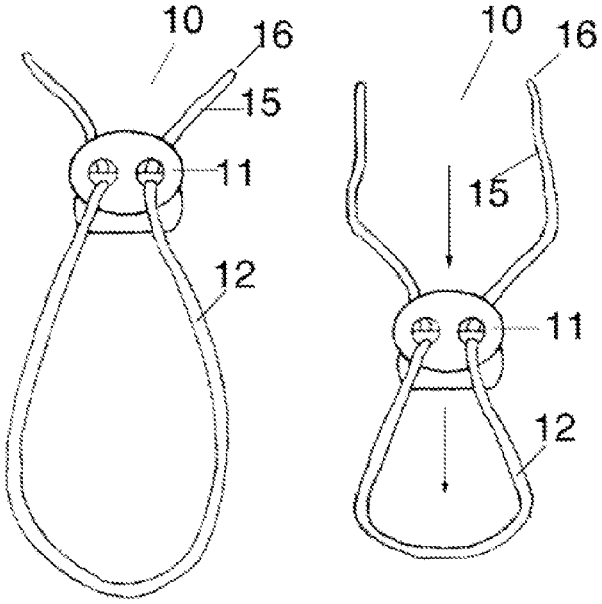
FIG. 5 displays an angled top view of how to adjust the stitch holder using the locking fastener.

FIG. 5 illustrates how the string 12 can be adjusted to different sizes. For example, the locking fastener 11 can be configured to facilitate any length or loop circumference needed for desired project based on the length of the string 12. To adjust the length of the string 12 needed for an item, simply open and slide in the direction of the arrows the locking fastener 11 to the desired size or length leaving enough desired length 15 of the string ends 16 for the locking fastener 11 to secure. This length 15 should be long enough so that if the string 12 is accidently pulled hard, then the chance that the ends will slip out of the locking fastener 11 is significantly reduced.

FIG. 6 illustrates how to use the stitch holder assembly 10 for flat knit pieces or as a straight line stitch holder. Secure one string end 17 with a locking fastener 30, pick up stitches as demonstrated in FIG. 4 and use a second locking fastener 11 to secure the string end 16. This variation allows flat knit pieces to stay flat and not be forced into a circular shape. Using FIG. 6 instructions, two finished pieces of knit material can be basted together using the string 12 and two fasteners 11 to determine if the pieces will fit together as desired. Another variation is to use two or more locking fasteners 11 and two or more lengths of string 12.

In FIG. 7, the first string 27 is secured through an open hole 14 on fastener one 25. The live stitches 18 are placed on the string 27, and the unsecured end is secured with the second fastener 26. Once this is complete, the process is repeated with the second string 28 creating a larger circumference holder. This variation can use multiple locking fasteners and strings.

Figure 8:
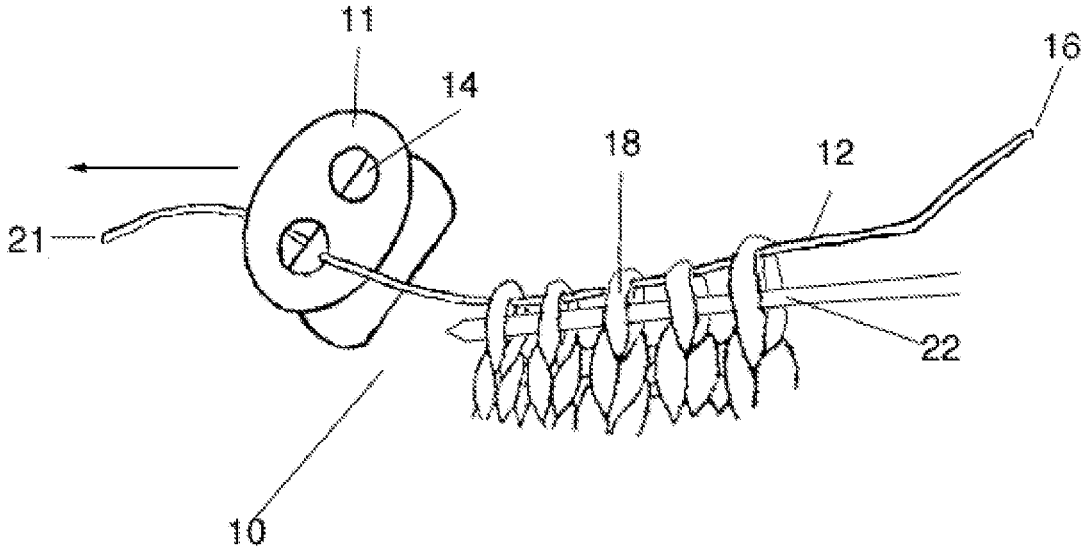
FIG. 8 illustrates a head on view of how to remove stitches from the adjustable stitch holder.

FIG. 8 illustrates the removal of the live stitches 18 from the stitch holder assembly 10 to be placed on the working knitting needle 22. Open the locking fastener 11 and pull the needed end 16 of the string 12 through the hole 14 and release the locking fastener 11 to lock in the other end 21 of the string 12. Push the working knitting needle 22 through each live stitch 18 keeping the string 12 in place until all desired stitches 18 are replaced to the working knitting needle 22. If there are remaining stitches 18 on the string 12 needed for later, replace the string end 16 back through the hole 14 to secure for a later time. Once the stitch holder 10 is no longer needed (e.g. all the stitches 18 have been transferred to the knitting needle 22), slide the string 12 out of the stitches 18, in the direction of the arrow, that have been placed on the working knitting needle 22. Then secure one end 21 of the string 12 with the locking fastener 11 and store.

An alternative is to keep the string 12 with the end 16 secured in the hole 14 with the stitches 18 remaining on the string 12 while knitting to track pattern progress or stitch count (e.g. starting row, lace repeats, patterned, cabled, or charted knitting, etc.). Since the materials are small locking fasteners 11 and string 12 that is flexible three of these stitch holders can fit into a small knitting notions case (e.g. Altoids gum tin) alongside other knitting notions (e.g. locking and regular stitch markers and tapestry needle) making these stitch holders 10 easier to transport and store thus more efficient.

While the foregoing written description of the embodiment enables one of ordinary skill to make and use what is considered presently to be the best mode thereof, those of ordinary skill will understand and appreciate the existence of variations, combinations, and equivalents of the specific embodiment, method, and examples herein. The described embodiment should therefore not be limited by the above described method, and examples, but by all embodiments and methods within the scope and spirit of the invention.

What is claimed is:

1. A method for holding a knitted product with a locking fastener comprising:

providing a locking fastener having an outer element, the outer element having a groove formed by walls and a peripheral traverse slot, wherein the peripheral traverse slot passes through the walls of the groove; an inner element partially disposed into the groove, the inner element comprising a slit which is a through hole that traverses the inner element; a spring mechanism connected to the partially disposed inner element and the groove, wherein the peripheral traverse slot and the slit increasingly overlap one another when the inner element moves towards the groove and compresses the spring mechanism, wherein the increasing overlap opens a passageway between the peripheral traverse slot and the slit, wherein the passageway is a channel configured to receive an end of a string;

activating the locking fastener by moving the inner and outer elements together thereby compressing the spring mechanism and creating the passageway;

placing one end of the string through the channel;

deactivating the locking fastener by allowing the elements to move away from each other thereby releasing the spring and closing the passageway, thus securing the one end of the string and leaving the other end of the string free to feed through live knitted stitches;

placing a predetermined number of live knitted stitches on the string from the free end being stopped by the secure end;

once all the live predetermined number of stitches are on the string, reactivating the locking fastener and placing the other free end of the string in the channel of the locking fastener, then deactivating the locking fastener thereby securing both ends of the string and thus also securing the live knitted stitches.

2. The method as recited in claim 1, wherein releasing the spring mechanism from compressed position moves the peripheral traverse slot in tangential position to the slit.

3. The method as recited in claim 1, wherein releasing the spring mechanism from compressed position pushes the inner element away from the groove, wherein the pushing of the inner element clamps the string against the outer element.

4. The method as recited in claim 1, wherein an alignment between the peripheral traverse slot and the slit maximizes an opening of the passageway, wherein the maximized opening of the passageway is equal or greater than a diameter of the flexible string.

5. The method as recited in claim 1 further comprising a stopper mechanism attached to the outer element, wherein the stopper mechanism limits a maximum reach of the inner element when moving up and down into the groove.

6. The method as recited in claim 1, wherein the outer element has a surface perimeter that is greater than the surface perimeter of the knitted product, wherein the string collects the knitted product.

7. The method as recited in claim 1, wherein connecting the string to the locking fastener involves the inner element moving towards the groove and opening the channel, accepting the string into the channel, and releasing the spring mechanism from compression.

8. The method as recited in claim 1, wherein the string is made of a flexible material.

* * * * *